United States Patent [19]

Okamoto

[11] Patent Number: 4,701,730

[45] Date of Patent: Oct. 20, 1987

[54] INDUCTIVE RADIO ANTENNA CABLE

[75] Inventor: Kunihiko Okamoto, Kanagawa, Japan

[73] Assignee: Hitachi Cable Ltd., Tokyo, Japan

[21] Appl. No.: 867,667

[22] Filed: May 28, 1986

[51] Int. Cl.[4] ..... H01P 3/06; H01Q 13/20

[52] U.S. Cl. ..... 333/237; 343/770; 343/895

[58] Field of Search ..... 333/237, 243; 343/770, 343/895; 336/195

[56] References Cited

U.S. PATENT DOCUMENTS 2,769,149 10/1956 Kreer, Jr. ..... 333/243

3,299,375 1/1967 Thompson ..... 333/243

*Primary Examiner*—Paul Gensler

*Attorney, Agent, or Firm*—Sughrue, Mion, Zinn, Macpeak & Seas

[57] ABSTRACT

A coaxial inductive radio cable for use as an antenna in which both the inner and outer conductor are wound in spirals having the same spiral winding orientation and the pitch of the outer spiral conductor is two or three times the pitch of the inner spiral conductor.

2 Claims, 4 Drawing Figures

INDUCTIVE RADIO ANTENNA CABLE

BACKGROUND

1. Field of the Invention

The present invention relates to an inductive radio cable used for mobile radio communication carried out on a road, on a railway, in a tunnel, or the like.

2. Background Art

FIG. 1 shows a conventionally known inductive radio cable. In the drawing, a core 1 is made of a magnetic material or an insulator and is successively covered by an inner conductor 2, an insulator 3, an outer conductor 4 and a sheath 5. The inner and outer conductors 2 and 4 are formed by spirally winding conductors on the outer peripheries of the core 1 and the insulator 3 respectively, the inner conductor 2 being wound in the direction opposite to the outer conductor 4.

A current flowing between the inner and outer conductors is inductively radiated into a space outside the inductive radio cable, so that the radiation can be received by an antenna on a moving vehicle.

In the thus described inductive radio cable, however, transmission loss is so large that there is such a problem that a complete inductive radio system becomes expensive because it requires a number of repeaters when the inductive radio cable extends over a long distance.

SUMMARY OF THE INVENTION

Accordingly, an object of the present invention is to provide an inductive cable antenna with a low transmission loss.

According to the present invention, the inductive radio cable has a conductor that is spirally wound around the outer periphery of a core to form an inner conductor, an insulator is provided around the inner conductor, and another conductor, forming an outer conductor, is spirally wound around the outer periphery of the insulator in the same winding direction as the inner conductor with a winding pitch not smaller than twice but not larger than three times that of the inner conductor.

DETAILED DESCRIPTION OF THE PREFERRED EMBODIMENTS

In order to solve this problem in the prior art, the inventors of this application have proposed an inductive radio cable suitable for long-distance communication, in which an expected result is that transmission loss is reduced and high electric field intensity can be obtained.

That is, the proposed inductive radio cable is arranged such that a conductor is spirally wound around the outer periphery of a core to form an inner conductor thereon, an insulator is provided around the outer periphery of the inner conductor, and another conductor is spirally wound around the outer periphery of the insulator in the same winding direction as the latter to form an outer conductor. In this conductive radio cable, the inner and outer conductors are wound in the same direction with each other so that a signal from a high-frequency power source excite an earth return circuit so as to be received by an antenna of any mobile in the neighborhood.

As the result of further investigation for the purpose of making the intensity of the externally produced electromagnetic field stronger in the proposed inductive radio cable, the inventors of this application have found that the purpose can be realized by defining the ratio of winding pitch of the inner and outer conductors to be a specific value. Thus, the present invention is proposed here.

Figure 1:
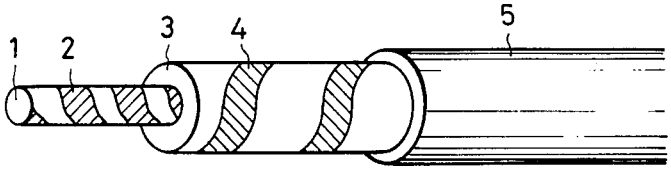
FIG. 1 PRIOR ART
FIG. 1 is a diagram illustrating an example of the conventional inductive radio cable.
Figure 2:
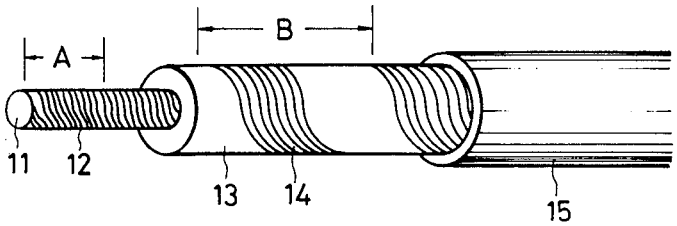
FIG. 2 is a diagram illustrating an embodiment according to the present invention.

FIG. 2 shows an embodiment according to the present invention. In the drawing, core 11 is made of a magnetic material or an insulator. An inner conductor 12 is formed by spirally winding a copper wire around the outer periphery of the core 11 with a pitch A. An insulator 13 covers the inner conductor. An outer conductor 14 is formed by spirally winding a copper wire around the outer periphery of the insulator 13 with a pitch B. A plastic sheath 15 covers the outer conductor.

The winding direction of the copper wire of the inner conductor 12 is the same as the outer conductor 14, and the pitch B of the outer conductor 14 is selected to take a value not smaller than two times but not larger than three times as much as the pitch A of the inner conductor 12.

As should be apparent from FIG. 2, the inner and outer conductors 12 and 14 need not be single conductors but may each be composed of parallel filamentary conductors. In this case, the pitches A and B are the pitches between adjacent windings of the same filament, not between adjacent filaments.

The reason why the pitch B is selected to take a value not smaller than twice but not larger than three times as much as the pitch A is as follows.

In this cable according to the present invention, a circuit between the earth and the outer conductor is caused to excite by the inductance of the outer conductor so as to cause ground current to flow through the circuit, so that an electromagnetic field of strong intensity is induced in the external space. The intensity of the electromagnetic field is proportional to $Z_T/\phi$ where $Z_T$ represents the coupling impedance of the outer conductor and $\phi$ represents the phase constant of the coaxial cable.

That is, in order to increase the intensity of the external electromagnetic field, it is necessary to make the coupling impedance $Z_T$ of the outer conductor larger and hence to make the inductance L of the outer conductor large because $Z_T = j\omega L$. It is also necessary to make the phase constant $\phi$ of the coaxial cable not be large, and hence to make the total inductance $L_0$ of the coaxial cable not be large. The self inductance L and the mutual inductance $M_{12}$ of the inner and outer conductors can be expressed as follows:

Inner conductor:

$$L_1 = \pi a^2 \mu_1 \mu_0 N_1^2$$

$$M_{12} = \pi a^2 \mu_1 \mu_0 N_1 N_2$$

Outer conductor:

$$L_2=\pi N_2^2\mu_0[a^2\mu_1+(b^2-a^2)]$$

$$M_{12}=\pi a^2\mu_1\mu_0 N_1 N_2$$

where a represents the radius of the core; $\mu_1$, the permeability coefficient for the core 1; $\mu_0$, the permeability constant for free space; $N_1$, the number of turns of the inner coil; $N_2$, the number of turns of the outer coil; and b the radius of the outer coil. The pitches are inversely proportional to the number of turns so that $A/B=N_2/N_1$.

Figure 3:
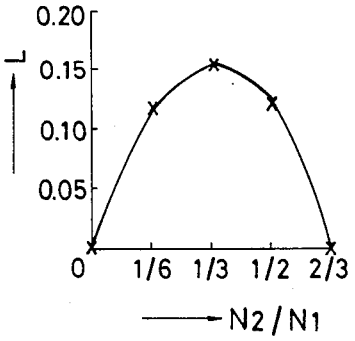
FIGS. 3 and 4 show the inductance values relative to the turn ratio of the inner and outer conductors in the inductive radio cable according to the present invention, in which FIG. 3 relates to the inductance value of the outer conductor and FIG. 4 relates to the total inductance value.
Figure 4:
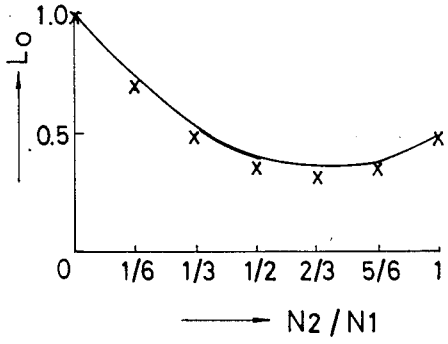

Therefore, the conditions that the inductance of the outer conductor $L=M_{12}-L_2$ is maximized and the total inductance $L_0=L_1-2M_{12}+L_2$ is minimized can be calculated as shown in FIGS. 3 and 4 respectively (the calculations are made with b=2a). As seen from the drawings, the inductance L of the outer conductor can be set to near its maximum and the total inductance $L_0$ can be made as small as possible, if the turn ratio $N_2/N_1$ is restricted to the range from $\frac{1}{3}$ to $\frac{1}{2}$, both inclusive numbers.

As described above, in the inductive radio cable according to the present invention, the inner and outer conductors are wound in the same direction with each other and the winding pitches thereof are specifically defined. It is thereby possible to obtain an inductive radio cable having a small transmission loss and a strong electromagnetic field intensity, which could not be realized in the prior art. Accordingly, the inductive radio cable antenna according to the present invention is exceedingly advantageous when used in an inductive radio system which requires long-distance communication.

What is claimed is:

1. An inductive radio cable, comprising:

a core;

a conductor spirally wound around the outer periphery of said core to form an inner conductor;

an insulator around the outer periphery of the inner conductor; and another conductor spirally wound around the outer periphery of the insulator in the same winding direction as the inner conductor to form an outer conductor;

wherein the spiral winding pitch of said outer conductor is not smaller than two times and not larger than three times the spiral winding pitch of said inner conductor.

2. An inductive radio cable as recited in claim 1, wherein said core comprises a magnetic material having a magnetic permeability greater than one.

* * * * *